US010907321B2

(12) United States Patent
Cho et al.

(10) Patent No.: US 10,907,321 B2
(45) Date of Patent: Feb. 2, 2021

(54) CONSTRUCTION MACHINERY AND METHOD OF CONTROLLING CONSTRUCTION MACHINERY

(71) Applicant: DOOSAN INFRACORE CO., LTD, Incheon (KR)

(72) Inventors: Young Shik Cho, Incheon (KR); Woo Yong Jung, Incheon (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 308 days.

(21) Appl. No.: 15/745,335

(22) PCT Filed: Jul. 15, 2016

(86) PCT No.: PCT/KR2016/007732
§ 371 (c)(1),
(2) Date: Jan. 16, 2018

(87) PCT Pub. No.: WO2017/010840
PCT Pub. Date: Jan. 19, 2017

(65) Prior Publication Data

US 2018/0209121 A1 Jul. 26, 2018

(30) Foreign Application Priority Data

Jul. 15, 2015 (KR) ..... 10-2015-0100201

(51) Int. Cl.
*E02F 9/22* (2006.01)
*E02F 9/20* (2006.01)
*F15B 11/17* (2006.01)

(52) U.S. Cl.
CPC ..... *E02F 9/22* (2013.01); *E02F 9/20* (2013.01); *E02F 9/2004* (2013.01);
(Continued)

(58) Field of Classification Search
CPC ... E02F 9/22; E02F 9/20; E02F 9/2235; E02F 9/2246; E02F 9/2004; E02F 9/2271;
(Continued)

(56) References Cited

U.S. PATENT DOCUMENTS 5,590,041 A * 12/1996 Cooper ..... E02F 9/2004 701/41
5,944,492 A * 8/1999 Konishi et al. ..... E02F 9/2235 60/430

(Continued)

FOREIGN PATENT DOCUMENTS

CN 1208814 A 2/1999
CN 101598123 A 12/2009

(Continued)

OTHER PUBLICATIONS

International Search Report for PCT/KR2016/007732 dated Nov. 15, 2016.

(Continued)

*Primary Examiner* — Dale W Hilgendorf
(74) *Attorney, Agent, or Firm* — Hauptman Ham, LLP

(57) ABSTRACT

Disclosed are a construction machine and a method of controlling a construction machine. The construction machine includes: a first pump and a second pump; an engine which provides available torque to the first pump and the second pump; a first joystick and a second joystick which control actuators operated by a working fluid discharged from the first pump and the second pump; a joystick operation amount acquiring unit which acquires operation amounts of the first joystick and the second joystick; and a control unit which adjusts a torque distribution ratio with respect to the first pump and the second pump in accordance with the operation amounts of the first joystick and the second joystick when a sum of required torque of the first (Continued)

pump and required torque of the second pump is higher than the available torque.

10 Claims, 5 Drawing Sheets

(52) U.S. Cl.
CPC ..... *E02F 9/2235* (2013.01); *E02F 9/2246* (2013.01); *E02F 9/2271* (2013.01); *E02F 9/2292* (2013.01); *F15B 11/17* (2013.01); *E02F 9/2285* (2013.01); *E02F 9/2296* (2013.01); *F15B 2211/20576* (2013.01); *F15B 2211/6651* (2013.01); *F15B 2211/71* (2013.01)

(58) Field of Classification Search
CPC ..... E02F 9/2292; E02F 9/2285; E02F 9/2296; F15B 11/17; F15B 2211/20576; F15B 2211/6651; F15B 2211/71
See application file for complete search history.

(56) References Cited

U.S. PATENT DOCUMENTS

| | | | | |
|---|---|---|---|---|
| 6,020,651 | A | 2/2000 | Nakamura et al. | |
| 6,050,090 | A * | 4/2000 | Tohji | F15B 11/17 60/421 |
| 8,347,619 | B2 * | 1/2013 | Kim | E02F 9/2235 60/428 |
| 8,606,442 | B2 | 12/2013 | Kang et al. | |
| 2014/0084831 | A1 * | 3/2014 | Kawaguchi et al. | E02F 9/2292 318/434 |
| 2016/0047398 | A1 * | 2/2016 | Cho et al. | E02F 9/2235 60/428 |
| 2016/0265195 | A1 * | 9/2016 | Imura et al. | E02F 9/2235 |

FOREIGN PATENT DOCUMENTS

| | | | |
|---|---|---|---|
| CN | 101987620 | A | 3/2011 |
| EP | 0884422 | A2 | 12/1998 |
| EP | 2130980 | A2 | 12/2009 |
| EP | 2284321 | A2 | 2/2011 |
| JP | 2003-090302 | A | 3/2003 |
| KR | 1995-0004017 | B1 | 4/1995 |
| KR | 10-2011-0069630 | A | 6/2011 |
| KR | 10-1112136 | B1 | 2/2012 |
| WO | 2014115905 | A1 | 7/2014 |

OTHER PUBLICATIONS

Chinese Office Action dated Aug. 28, 2019, in connection with counterpart Chinese Patent Application No. 201680040811.1.
Extended European Search Report dated Mar. 14, 2019, in connection with the European Patent Application No. 16824756.7.

* cited by examiner

【FIG. 1】
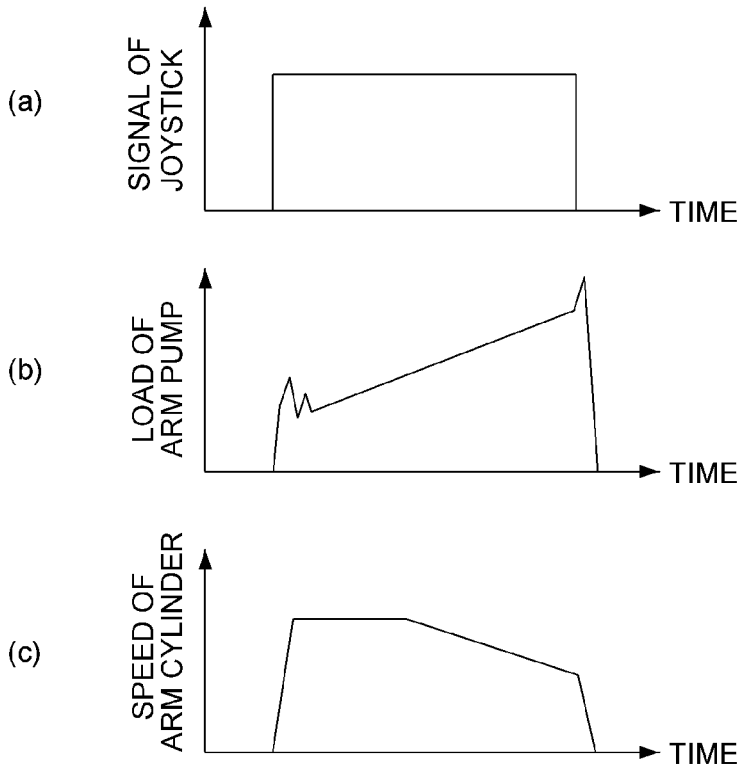

【 FIG. 2】
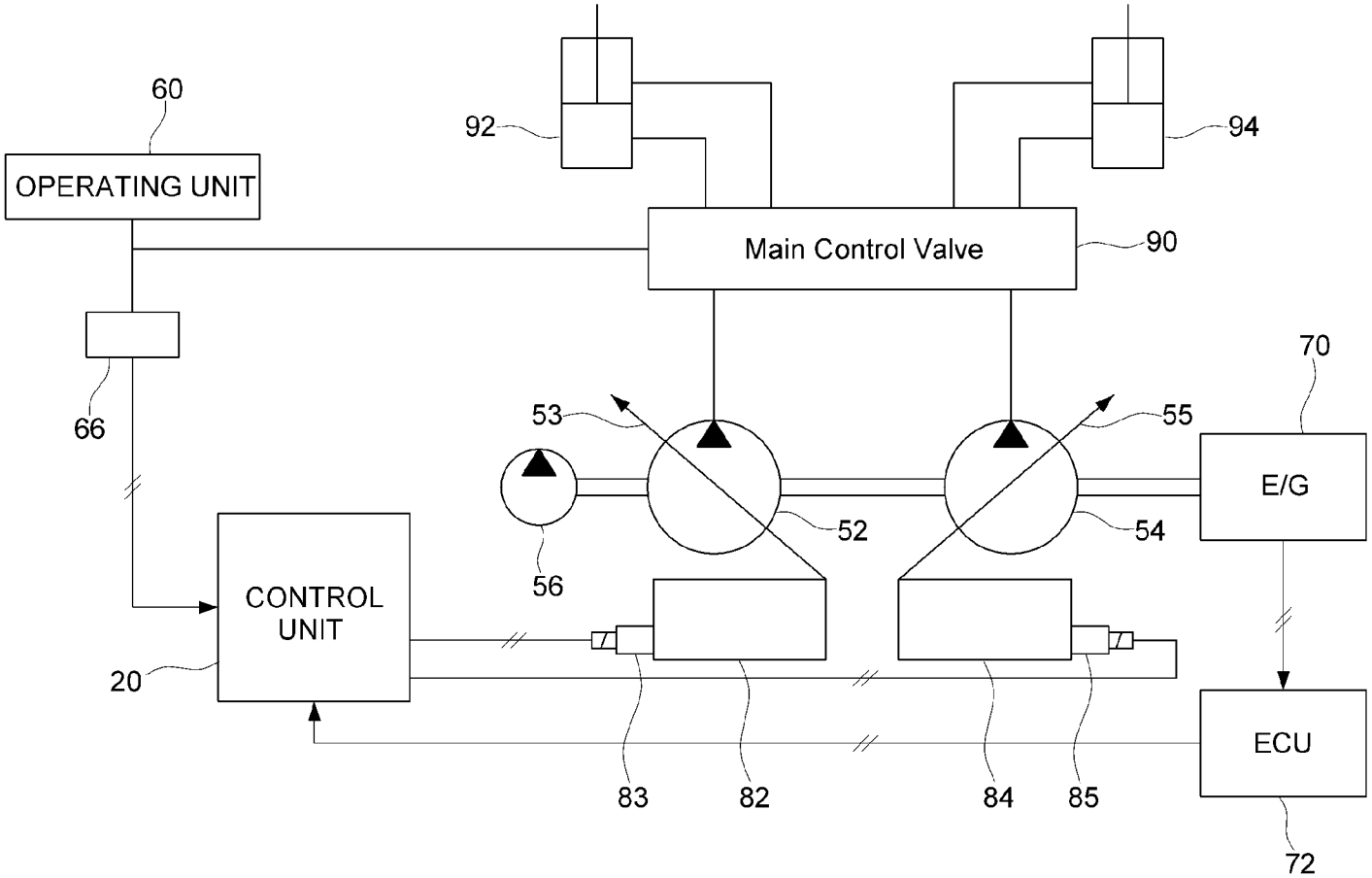

[ FIG. 3 ]
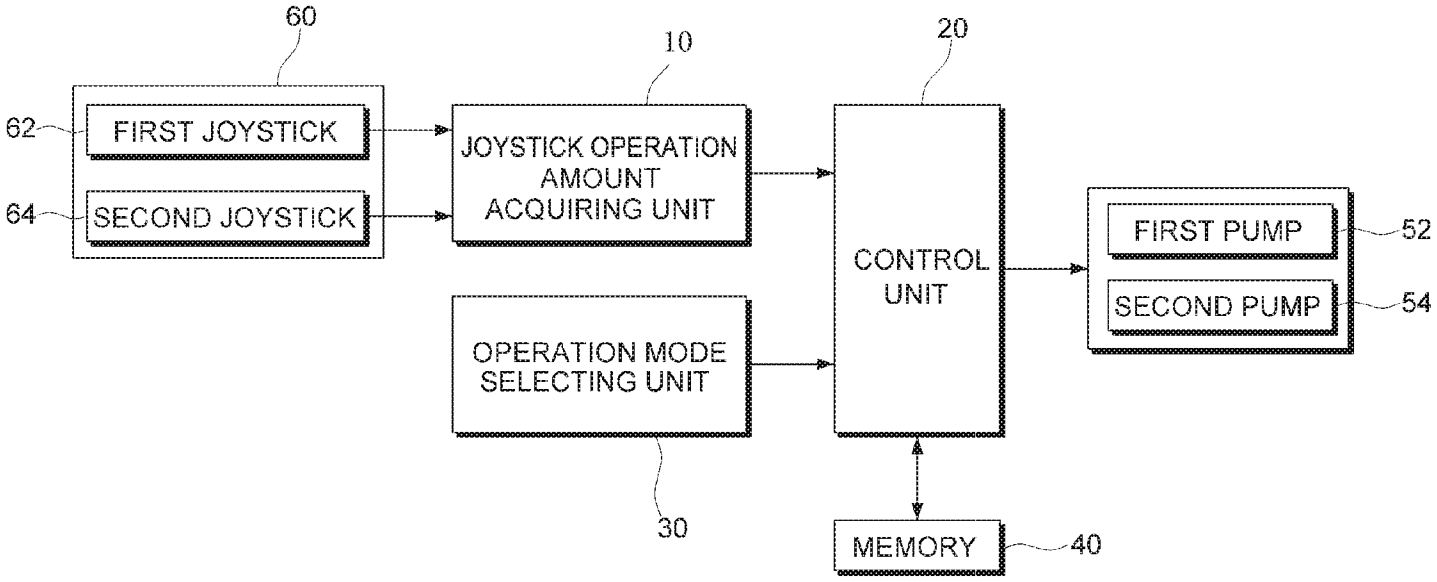

【FIG. 4】
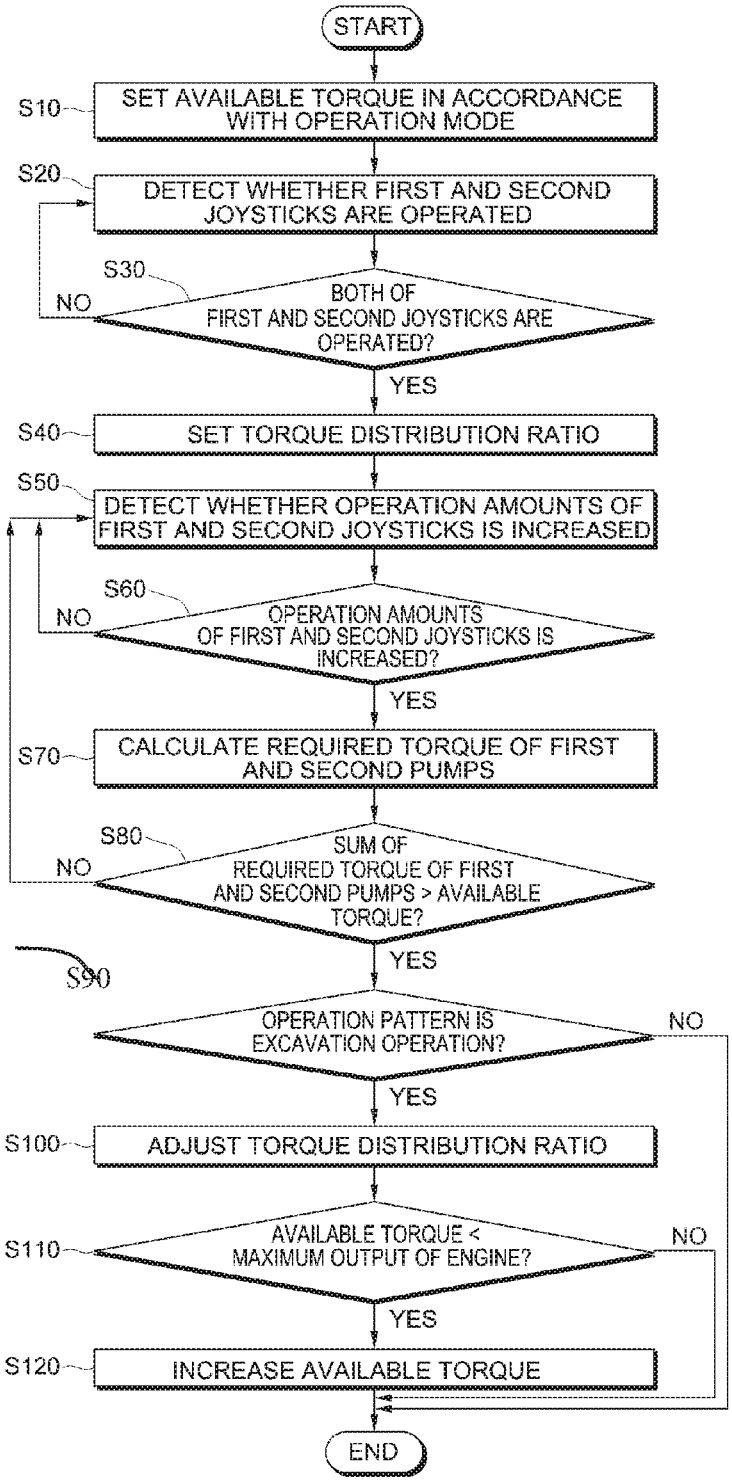

[FIG.5]

CONSTRUCTION MACHINERY AND METHOD OF CONTROLLING CONSTRUCTION MACHINERY

CROSS REFERENCE TO RELATED APPLICATION

This present application is a national stage filing under 35 U.S.C § 371 of PCT application number PCT/KR2016/007732 filed on Jul. 15, 2016 which is based upon and claims the benefit of priority to Korean Patent Application No. 10-2015-0100201 filed on Jul. 15, 2015 in the Korean Intellectual Property Office. The disclosures of the above-listed applications are hereby incorporated by reference herein in their entirety.

TECHNICAL FIELD

The present disclosure relates to a construction machine and a method of controlling a construction machine.

BACKGROUND ART

In general, a construction machine such as an excavator operates multiple working units including a boom, an arm, and a bucket by using a working fluid discharged from a variable capacity hydraulic pump operated by an engine. The excavator may be provided with two or more hydraulic pumps, and available torque outputted from the engine is limited, such that the hydraulic pumps need to share the available torque, and as a result, the available torque is distributed to the respective hydraulic pumps in consideration of various factors in order to meet various conditions such as working efficiency and fuel economy.

Required torque of the hydraulic pump may be represented by the following expression.

$$\text{Required Torque} = \text{Required Pressure} \times \text{Required Flow Rate}$$

Meanwhile, the required torque required for particular operations of the excavator may vary in accordance with the respective operations. For example, the operations such as a boom raising operation and an arm crowd operation require higher torque than other operations, while the operations such as a boom lowering operation and an upper body swinging operation require lower torque than other operations. Therefore, it is important to appropriately distribute torque to the hydraulic pumps for supplying the working fluid to actuators for performing the corresponding operations in accordance with the type of operation performed by the excavator, and if the torque is not appropriately distributed to the corresponding hydraulic pump, the corresponding operation is performed slowly or cannot be performed in some instances. Therefore, it is necessary to appropriately distribute the limited available torque to the respective pumps in accordance with a user's operation intention.

DOCUMENT OF RELATED ART

Patent Document (Patent Document 1) KR10-2001-0033699 A

DISCLOSURE

Technical Problem

The present disclosure has been made in an effort to solve the aforementioned problems in the related art, and an object of the present disclosure is to provide a construction machine and a method of controlling a construction machine, which are capable of flexibly distributing available torque to multiple pumps to meet a user's operation intention.

Technical Solution

To solve the aforementioned problem, the present disclosure may provide a construction machine including: a first pump and a second pump; an engine which provides available torque to the first pump and the second pump; a first joystick and a second joystick which control actuators operated by a working fluid discharged from the first pump and the second pump; a joystick operation amount acquiring unit which acquires operation amounts of the first joystick and the second joystick; and a control unit which adjusts a torque distribution ratio with respect to the first pump and the second pump in accordance with the operation amounts of the first joystick and the second joystick when a sum of required torque of the first pump and required torque of the second pump is higher than the available torque.

In this case, the actuators may include a boom actuator, an arm actuator, a bucket actuator, and a turning actuator, the first joystick may control at least two actuators among the boom actuator, the arm actuator, the bucket actuator, and the turning actuator, and the second joystick may control the remaining actuators.

In addition, the control unit may determine the torque distribution ratio in accordance with types of complex operations of the boom actuator, the arm actuator, the bucket actuator, and the turning actuator.

In addition, when the operation amount of the first joystick or the second joystick is increased while the construction machine performs a complex operation in which both of the first joystick and the second joystick are operated, the control unit may adjust the torque distribution ratio in order to increase a distribution ratio with respect to the pump, between the first pump and the second pump, which supplies the working fluid to the actuator controlled by the joystick of which the operation amount is increased.

In addition, each of the first pump and the second pump may be an electronic control pump, and the required torque may be controlled by the control unit.

In addition, the construction machine may further include: an operation mode selecting unit which selects an operation mode of the construction machine, in which when the sum of the required torque of the first pump and the required torque of the second pump is higher than the available torque and the available torque is lower than a maximum output of the engine in the operation mode selected by the operation mode selecting unit, the control unit increases the available torque so that the available torque is equal to or lower than the maximum output of the engine in the operation mode.

In addition, the construction machine may further include a memory which stores the types of operation modes, and the available torque and the maximum output of the engine in accordance with the operation mode.

In addition, the present disclosure may provide a construction machine including: a first pump and a second pump; an engine which provides available torque to the first pump and the second pump; a first joystick and a second joystick which control actuators operated by a working fluid discharged from the first pump and the second pump; a joystick operation amount acquiring unit which acquires operation amounts of the first joystick and the second joystick; an operation mode selecting unit which selects an operation mode of the construction machine; and a control unit which, when the operation amount of the first joystick or the second joystick is increased while the construction machine performs a complex operation in which both of the first joystick and the second joystick are operated in a state in which a sum of required torque of the first pump and required torque of the second pump is higher than the available torque and the available torque is lower than a maximum output of the engine in the operation mode selected by the operation mode selecting unit, adjusts a torque distribution ratio in order to increase the available torque so that the available torque is equal to or lower than the maximum output of the engine in the operation mode and increase a distribution ratio with respect to the pump, between the first pump and the second pump, which supplies the working fluid to the actuator controlled by the joystick of which the operation amount is increased.

In addition, the present disclosure may provide a method of controlling a construction machine which distributes available torque, which is provided from an engine of the construction machine including a first pump and a second pump, to the first pump and the second pump, the method including: detecting whether both a first joystick and a second joystick are operated; setting a torque distribution ratio with respect to the first pump and the second pump when both of the first joystick and the second joystick are operated; detecting an operation amount of the first joystick or the second joystick; determining whether a sum of required torque of the first pump and required torque of the second pump is higher than the available torque; and adjusting the torque distribution ratio with respect to the first pump and the second pump in accordance with the operation amounts of the first joystick and the second joystick when the sum of the required torque of the first pump and the required torque of the second pump is higher than the available torque.

In this case, the method may include comparing the operation amount of the first joystick and the operation amount of the second joystick after the detecting of the operation amount of the first joystick or the second joystick.

In addition, the method may further include setting the available torque in accordance with an operation mode after the operation mode of the construction machine is selected.

In addition, the method may include analyzing an operation pattern of the first joystick and the second joystick, determining whether the operation pattern is an excavation operation, and adjusting the torque distribution ratio with respect to the first pump and the second pump in accordance with the operation amounts of the first joystick and the second joystick only when it is determined that the operation pattern is the excavation operation.

Advantageous Effects

According to the exemplary embodiment of the present disclosure, a distribution ratio of the available torque with respect to the first and second pumps is primarily set in accordance with types of complex operations and then a torque distribution ratio is adjusted in accordance with a change in operation amount of the joystick, and as a result, it is possible to operate the construction machine so as to more appropriately meet the user's intention.

DESCRIPTION OF DRAWINGS

FIG. 1 is a graph illustrating an example in which a speed of an arm cylinder and a load of an arm pump are changed in accordance with an operating signal of a joystick at the time of an arm crowd operation of an excavator.

FIG. 2 is a view illustrating an example of a hydraulic system of a construction machine according to an exemplary embodiment of the present disclosure.

FIG. 3 is a view illustrating a configuration of the construction machine according to the exemplary embodiment of the present disclosure.

FIG. 4 is a flowchart of a method of controlling the construction machine according to the exemplary embodiment of the present disclosure.

DESCRIPTION OF MAIN REFERENCE NUMERALS OF DRAWINGS

Figures 5A, 5B:
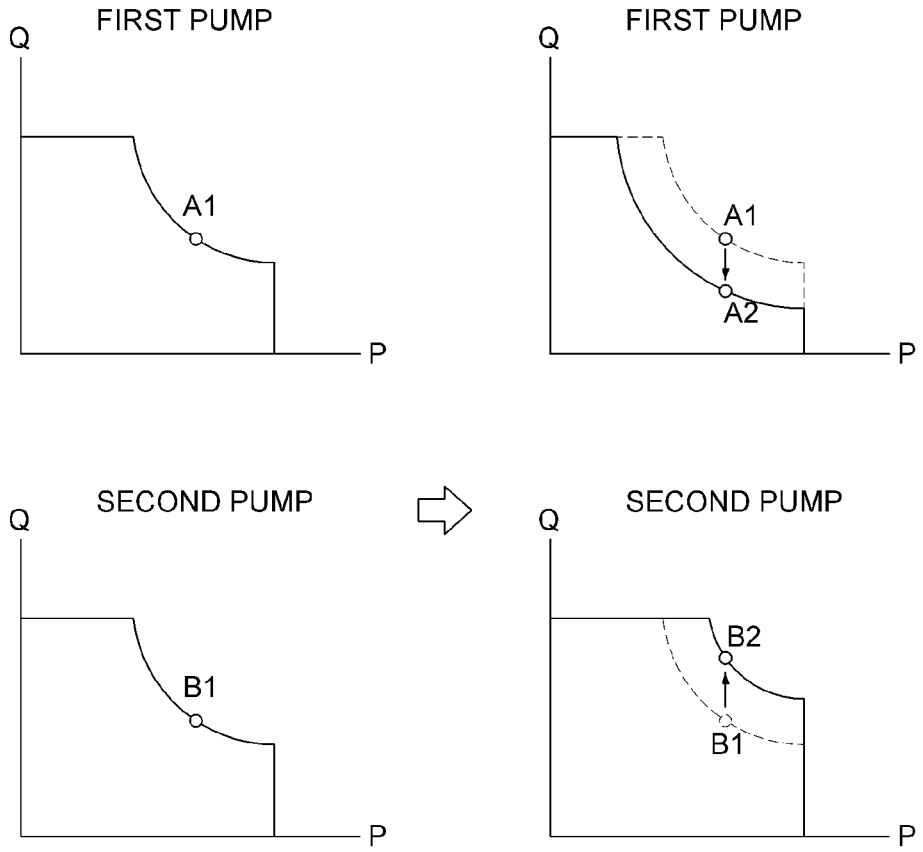
FIG. 5 is a view illustrating an example in which available torque is distributed to a first pump and a second pump by the method of controlling the construction machine according to the exemplary embodiment of the present disclosure.

10: Joystick operation amount acquiring unit
20: Control unit
30: Operation mode selecting unit
40: Memory
52, 54: First and second hydraulic pumps
53, 55: Swash plate
62, 64: First and second joysticks
66: Pressure sensor
70: Engine
72: Engine control unit
82, 84: Regulator
83, 85: Electronic proportional pressure reducing valve
90: Main control valve
92, 94: Actuator

BEST MODE

Hereinafter, exemplary embodiments of the present disclosure will be described in detail with reference to the accompanying drawings. First, in denoting reference numerals to constituent elements of the respective drawings, it should be noted that the same constituent elements will be designated by the same reference numerals, if possible, even though the constituent elements are illustrated in different drawings. Further, in the following description of the present disclosure, a detailed description of publicly known configurations or functions incorporated herein will be omitted when it is determined that the detailed description may make the subject matter of the present disclosure unclear.

As one of the methods of distributing available torque to hydraulic pumps, there is a method of designating a distribution ratio of torque to be distributed to the respective hydraulic pumps in accordance with a particular single operation or two or more particular complex operations to be performed by an excavator, and then always distributing torque in accordance with the designated distribution ratio when performing the corresponding operation.

FIG. 1 is a graph illustrating an example in which a speed of an arm cylinder and a load of a hydraulic pump for supplying a working fluid to the arm cylinder are changed in accordance with an operating signal of a joystick at the time of an arm crowd operation of an excavator. For example, the arm crowd operation is involved when the excavator digs soil from the ground and loads the soil onto a vehicle, and a load of the arm pump for supplying the working fluid to the arm cylinder is continuously increased at the time of the arm crowd operation, as illustrated in FIG. 1. Therefore, even though a user operates the joystick with an equal operation amount, a flow rate of the working fluid of the arm pump is decreased in proportion to an increase in load after a point in time at which required torque of the arm pump reaches available torque as a load of the arm pump is increased. A speed at which the arm cylinder is compressed is decreased as a flow rate of the working fluid of the arm pump is decreased, and in this case, there are problems in that because an operation speed of an arm is decreased even though the user does not change the operation amount of the joystick, a user is inconvenienced to use the excavator, a working speed is decreased, and reliability of equipment deteriorates because the excavator is mistook as being abnormal even though the excavator is normally operated.

In the case of a single operation in which only a single type of actuator is operated, these problems may be solved somewhat by maximally distributing available torque to a hydraulic pump for supplying a working fluid to the corresponding actuator. However, in the case of a complex operation in which two or more types of actuators are operated together, there is no additional torque to be supplied to operate the pumps in a state in which a sum of required torque of the respective pumps exceeds the available torque, and as a result, it is necessary to appropriately distribute the limited available torque to the respective pumps in accordance with the user's operation intention.

FIG. 2 is a view illustrating an example of a hydraulic system of a construction machine according to an exemplary embodiment of the present disclosure, and FIG. 3 is a view illustrating a configuration of the construction machine according to the exemplary embodiment of the present disclosure.

Referring to FIG. 2, the construction machine according to the exemplary embodiment of the present disclosure may be an apparatus, for example, an excavator including a hydraulic system provided with hydraulic pumps 52, 54, and 56. The construction machine may include the hydraulic pumps 52, 54, and 56, actuators 92 and 94, an engine 70, an operating unit 60, a pressure sensor 66, a control unit 20, and electronic proportional pressure reducing valves 83 and 85, and regulators 82 and 84. Hereinafter, the hydraulic pump is simply referred to as a pump. Referring to FIG. 3, the construction machine according to the exemplary embodiment of the present disclosure may further include a joystick operation amount acquiring unit 10, an operation mode selecting unit 30, and a memory 40.

The hydraulic pumps 52, 54, and 56 may include main pumps 52 and 54 and a sub pump 56. The main pumps 52 and 54 may include a first pump 52 and a second pump 54. The first and second pumps 52 and 54 may supply a working fluid to the actuators 92 and 94 so that the construction machine performs a particular operation. Each of the actuators 92 and 94 may include a hydraulic cylinder and a hydraulic motor. In addition, the actuators 92 and 94 may include a boom actuator, an arm actuator, a bucket actuator, and a turning actuator. The sub pump 56 may supply a pilot working fluid to the operating unit 60, and may supply the working fluid to additional hydraulic devices. The first and second pumps 52 and 54 and the sub pump 56 may be operated by the same driving source, and the driving source may be the engine 70. The engine 70 may be controlled by an engine control unit (ECU) 72, and the engine control unit 72 may provide the control unit 20 with information about an engine rotational speed, output torque, and the like of the engine 70.

The first and second pumps 52 and 54 may be bidirectional pumps which may discharge the working fluid in two directions, and may be variable capacity pumps capable of adjusting a discharge flow rate by changing inclination angles of swash plates 53 and 55, that is, by changing swash plate angles. The swash plates 53 and 55 of the first and second pumps 52 and 54 may be provided with swash plate angle sensors (not illustrated), and the swash plate angle sensors may detect the swash plate angles of the first and second pumps 52 and 54 and output the swash plate angles to the control unit 20.

The operating unit 60 is configured to be operated by the user in order to control the operation of the excavator. The operating unit 60 may include first and second joysticks 62 and 64. In this case, the first joystick 62 may be configured to control at least two actuators among the boom actuator, the arm actuator, the bucket actuator, and the turning actuator, and the second joystick 64 may be configured to control the remaining two actuators which are not controlled by the first joystick 62. In the present exemplary embodiment, a configuration in which the first pump 52 is a pump for supplying the working fluid to the actuators to be controlled by the first joystick 62 and the second pump 54 is a pump for supplying the working fluid to the actuators to be controlled by the second joystick 64 will be described.

In a case in which pilot pressure is generated by the operation of the operating unit 60, the pilot pressure generated by the operation of the operating unit 60 is detected by the pressure sensor 66, a detected value is converted into a digital signal, and the digital signal may be inputted to the control unit 20. In addition, in a case in which an electrical signal is generated by the operation of the operating unit 60, the electrical signal generated by the operation of the operating unit 60 may be inputted directly to the control unit 20. The control unit 20 may output a control signal for changing the angles of the swash plates 53 and 55 of the first and second pumps 52 and 54 in accordance with an operation direction and an operation amount of the operating unit 60, thereby changing a discharge flow rate and discharge pressure of the first and second pumps 52 and 54.

The electronic proportional pressure reducing (EPPR) valves 83 and 85 and the regulators 82 and 84 are configured to adjust the angles of the swash plates 53 and 55 of the first and second pumps 52 and 54 by the control signal of the control unit 20. The regulators 82 and 84 may be coupled to the swash plates 53 and 55 of the first and second pumps 52 and 54, respectively, and the electronic proportional pressure reducing valves 83 and 85 may be connected to the regulators 82 and 84, respectively. Pressurized oil may be supplied from the sub pump 56 to the electronic proportional pressure reducing valves 83 and 85, and the electronic proportional pressure reducing valves 83 and 85 may output the pressurized oil supplied from the sub pump 56 while adjusting pressure of the pressurized oil based on the control signal applied from the control unit 20. The pressurized oil outputted from the electronic proportional pressure reducing valves 83 and 85 is delivered to the regulators 82 and 84. The regulators 82 and 84 may change the discharge flow rates of the first and second pumps 52 and 54 by changing the angles of the swash plates 53 and 55 of the first and second pumps 52 and 54 in accordance with the pressure of the pressurized oil delivered from the electronic proportional pressure reducing valves 83 and 85. Meanwhile, in the present exemplary embodiment, the electronic proportional pressure reducing valves 83 and 85 and the regulators 82 and 84 are used to change the swash plate angles of the first and second pumps 52 and 54, but other devices may be used to change the swash plate angles of the first and second pumps 52 and 54 based on the control signal of the control unit 20.

As described above, the hydraulic system of the construction machine according to the exemplary embodiment of the present disclosure may be a pressure control type hydraulic pump system. In addition, the first and second pumps 52 and 54 may be an electronic control pump, and the required torque may be controlled by the control unit 20. In the pressure control type hydraulic pump system, the discharge pressure and the discharge flow rate of the first and second pumps 52 and 54 may be independently controlled by the electronic proportional pressure reducing valves 83 and 85 and the regulators 82 and 84 provided in the first and second pumps 52 and 54. Therefore, pump torque of the first and second pumps 52 and 54 may be independently controlled, and the overall available torque may be distributed to any one of the pumps.

A position of a spool of the main control valve 90 is changed in accordance with the hydraulic pressure signal or the electrical signal applied from the operating unit 60, thereby changing a flow direction of the working fluid. The working fluid discharged from the first and second pumps 52 and 54 is introduced into the main control valve 90, and when the first and second joysticks 62 and 64 are operated by the user, a position of the particular spool of the main control valve 90 is changed, such that the working fluid introduced into the main control valve 90 from the first and second pumps 52 and 54 may be supplied to the particular actuator. When the working fluid is supplied to the actuator, the actuator is operated by pressure of the working fluid, such that the construction machine may perform the particular operation. In the present description, an operation in which one or two or more actuators are operated by operating only any one of the first and second joysticks 62 and 64 is defined as a single operation, and an operation in which at least two actuators are operated by operating both of the first and second joysticks 62 and 64 is defined as a complex operation.

The operation mode selecting unit 30 is configured to control an output of the engine with at least two properties, and the operation mode selecting unit 30 may be provided in a cabin of the excavator so as to select an operation mode of the excavator. The operation mode selecting unit 30 may be implemented in various forms such as a toggle button, a touch screen, or a switching lever. The operation modes of the excavator may include at least two operation modes such as, for example, a power mode, a standard mode, and an economy mode. In the respective operation modes, a maximum output of the engine may be limited. For example, assuming that a maximum output of the engine in the power mode is 100, a maximum output of the engine may be set to be 80 in the standard mode and 60 in the economy mode. As described above, the types of operation modes and the maximum outputs of the engine in accordance with the operation modes may be stored in the memory 40, and when a particular operation mode is selected by the user, the control unit 20 may limit the output of the engine to an output equal to or lower than the maximum output of the corresponding operation mode stored in the memory 40. The user may select the operation mode of the excavator in consideration of a weight of an object operated by the excavator, a working speed, fuel economy of the engine, and the like, and the control unit 20 may automatically select the operation mode as necessary.

The joystick operation amount acquiring unit 10 may acquire the operation amounts of the first and second joysticks 62 and 64. The operation amounts of the first and second joysticks 62 and 64 may be a degree to which the first and second joysticks 62 and 64 are operated by the user. The operation amounts of the first and second joysticks 62 and 64 may be values in various forms, and for example, the operation amounts of the first and second joysticks 62 and 64 may be displacement or angles of the first and second joysticks 62 and 64. When the first and second joysticks 62 and 64 are operated, operating signals corresponding to operations of the first and second joysticks 62 and 64 may be generated. In this case, the operating signals may be signals in various forms such as a pressure signal, a voltage signal, and an electric current signal that may indicate the operation amounts of the first and second joysticks 62 and 64. The joystick operation amount acquiring unit 10 may be a device, such as an angle sensor for measuring the angles of the first and second joysticks 62 and 64, which directly acquires the operation amounts of the first and second joysticks 62 and 64, or may be a device which indirectly acquires the operation amounts of the first and second joysticks 62 and 64 by measuring pressure from a pressure signal generated by the operations of the first and second joysticks 62 and 64, or calculating a voltage signal or an electric current signal. In some instances, the joystick operation amount acquiring unit 10 may be a part of the control unit 20. When the first and second joysticks 62 and 64 are operated by the user, the operation amounts of the first and second joysticks 62 and 64 is acquired by the joystick operation amount acquiring unit 10, and the joystick operation amount acquiring unit 10 may output the operation amounts of the first and second joysticks 62 and 64 to the control unit 20.

The control unit 20 may output the control signal for distributing the available torque provided to operate the first and second pumps 52 and 54 to the first and second pumps 52 and 54 and controlling the first and second pumps 52 and 54. The majority of the torque outputted from the engine 70 is used to operate the first and second pumps 52 and 54, but may also be used to operate other driving elements such as the sub pump 56 and a cooling device. In the present description, the torque, which may be provided to operate the first and second pumps 52 and 54 among the overall torque outputted from the engine 70, is defined as the available torque. In addition, in the present description, a ratio of the available torque, which is outputted from the engine and distributed to the first and second pumps 52 and 54, is defined as a torque distribution ratio. The control unit 20 may distribute the available torque to the first and second pumps 52 and 54 in accordance with the torque distribution ratio, and may adjust the torque distribution ratio when the operation amount of the first joystick 62 or the second joystick 64 is increased during the complex operation. In the present exemplary embodiment, the torque distribution ratio is primarily set, and then the torque distribution ratio is adjusted when an increase in operation amount of any one of the joysticks is detected. Hereinafter, the determination and adjustment of the torque distribution ratio will be described.

The torque distribution ratio is a ratio of the available torque distributed to the first and second pumps 52 and 54. In the present exemplary embodiment, the torque distribution ratio is determined if both of the first and second joysticks 62 and 64 are operated. In this case, the operation amounts of the first and second joysticks 62 and 64 may not be considered. The torque distribution ratio may not be set if any one of the first and second joysticks 62 and 64 is operated, and the torque distribution ratio may be set only when both of the first and second joysticks 62 and 64 are operated. As described above, when both of the first and second joysticks 62 and 64 are operated, the complex operation of the hydraulic system is performed. When both of the first and second joysticks 62 and 64 are operated, the control unit 20 determines the torque distribution ratio. The torque distribution ratio may be determined in various manners. For example, the torque distribution ratio with respect to the first pump 52 and the second pump 54 may be a fixed ratio such as 50%:50% or 60%:40% regardless of the type of operation to be performed by the excavator. In addition, the torque distribution ratio may not be a fixed ratio, but may vary in accordance with the types of complex operations to be performed by the excavator. For example, as shown in the following table, the torque distribution ratios are set in advance in accordance with the types of complex operations that may be performed by the excavator, and then the torque distribution ratios may be stored in the memory 40. As described above, when the torque distribution ratios are set in advance in accordance with the types of complex operations, the control unit 20 may determine the torque distribution ratio based on a value set to the corresponding operation with reference to the memory 40 each time the excavator performs the corresponding complex operation.

TABLE 1

| Operation Mode | Type of Complex Operation | First Pump Torque Distribution Ratio (%) | Second Pump Torque Distribution Ratio (%) |
|---|---|---|---|
| 1 | Boom Raising Operation and Bucket Operation | 55 | 45 |
| 2 | Boom Lowering Operation and Bucket Operation | 50 | 50 |
| 3 | Arm Crowd Operation and Upper Body Swinging Operation | 50 | 50 |
| 4 | Arm Dump Operation and Upper Body Swinging Operation | 30 | 70 |
| 5 | Boom Raising Operation and Arm Operation | 50 | 50 |
| 6 | Boom Raising Operation and Upper Body Swinging Operation | 70 | 30 |
| 7 | Bucket Operation and Arm Operation | 50 | 50 |

In addition, the torque distribution ratio may be a ratio which is not set in advance, but is arbitrarily determined by the control unit 20 in consideration of various operating conditions such as pressure of the boom cylinder of the excavator, pressure of the arm cylinder, pressure of the bucket cylinder, an engine speed, and a coolant temperature.

Next, the torque distribution ratio may be adjusted when the operation amount of any one of the first and second joysticks 62 and 64 is increased after the torque distribution ratio is primarily determined. The user operates the joystick with a large operation amount if the user wants the particular actuator to operate quickly, but also the user operates the joystick with a small operation amount if the user wants the corresponding actuator to operate slowly. That is, a magnitude of the operation amount of the joystick may mean an operation speed of the corresponding actuator desired by the user. Therefore, an increase in operation amount of any one of the joysticks during the particular operation performed by the excavator is likely to mean that the operation, which is performed by the operation of the corresponding joystick, is not performed as quickly as desired by the user and the user wants the corresponding operation to be performed more quickly. However, no torque to be additionally distributed to the first and second pumps 52 and 54 remains in a state in which the required torque of the first and second pumps 52 and 54 in accordance with the operation of the joystick is higher than the available torque. Therefore, in this case, a part of the torque allocated to any one of the pumps is provided to the pump which supplies the working fluid to the actuator controlled by the joystick of which the operation amount is increased, and as a result, the construction machine may be operated to more appropriately meet the user's intention.

The control unit 20 detects whether the operation amount of any one of the first and second joysticks 62 and 64 is increased during the complex operation in order to enable the construction machine to operate in accordance with the user's operation intention. When an increase in operation amount of any one of the first and second joysticks 62 and 64 is detected during the complex operation, the control unit 20 may adjust the torque distribution ratio in order to increase the distribution ratio with respect to the pump, between the first pump 52 and the second pump 54, which supplies the working fluid to the actuator controlled by the joystick of which the operation amount is increased. In this case, the distribution ratio with respect to the other pump is consequently decreased. For example, in a case in which the operation amount of the first joystick 62 is increased in a state in which the torque distribution ratio with respect to the first pump 52 and the second pump 54 is set to 40%:60%, the control unit 20 may adjust the torque distribution ratio to 45%:55%, 50%:50%, 60%:40%, or the like. Therefore, torque may be distributed to the first pump 52 at a ratio larger than the originally set torque distribution ratio, and as a result, the actuator, which is operated by the joystick of which the operation amount is increased by the user, may be operated at a high speed desired by the user.

The torque distribution ratio may be adjusted in various manners. For example, the torque distribution ratio may be adjusted in proportion to an increase in operation amount of the joystick. On the other hand, the torque distribution ratio may be adjusted to a fixed ratio regardless of an increase in operation amount of the joystick. For example, in a case in which the operation amount of the first joystick 62 is increased in a state in which the torque distribution ratio with respect to the first and second pumps 52 and 54 is set to 50%:50%, the control unit 20 may adjust the torque distribution ratio to 70%:30%. On the contrary, in a case in which the operation amount of the second joystick 64 is increased, the control unit 20 may adjust the torque distribution ratio to 30%:70%. In addition, the torque distribution ratio may be adjusted in various manners.

Meanwhile, in a case in which a sum of the required torque of the first pump 52 and the required torque of the second pump 54 is higher than the available torque and the available torque is lower than a maximum output of the engine 70 in the operation mode selected by the operation mode selecting unit 30 while the construction machine performs the complex operation, the control unit 20 may change the available torque so that the available torque is equal to the maximum output of the engine 70 in the corresponding operation mode. The engine 70 provides a part of the output to additional devices such as an air conditioner compressor in addition to the first and second pumps 52 and 54 for supplying the working fluid to the actuators 92 and 94. Therefore, the available torque to be provided to the first and second pumps 52 and 54 is generally set to be lower than the maximum output of the engine 70, and for example, the available torque is set to be about 90% of the maximum output. By the way, in a case in which a sum of required torque of the first and second pumps 52 and 54 is higher than the available torque and the available torque is lower than the maximum output of the engine 70 in the operation mode selected by the operation mode selecting unit 30, the overall output of the engine 70, which is provided to the additional devices, is allocated to the available torque, such that higher torque may be provided to the first and second pumps 52 and 54, and as a result, the actuators 92 and 94 may be operated at a high speed.

Hereinafter, a process of distributing the available torque to the first and second pumps by a method of controlling the construction machine according to the present exemplary embodiment will be described with reference to constituent elements of a torque control device of the hydraulic pump.

FIG. 4 is a flowchart of a method of controlling the construction machine according to the exemplary embodiment of the present disclosure, and FIG. 5 is a view illustrating an example in which the available torque is distributed to the first pump and the second pump by the method of controlling the construction machine according to the exemplary embodiment of the present disclosure, in which FIG. 5A is a flow rate-pressure diagram in a state in which the available torque is distributed to the first and second pumps in accordance with the primarily set torque distribution ratio, and FIG. 5B is a flow rate-pressure diagram in a state in which the available torque is distributed to the first and second pumps in accordance with the torque distribution ratio which is primarily set and then adjusted.

The method of controlling the construction machine according to the exemplary embodiment of the present disclosure may include detecting whether both of the first joystick 62 and the second joystick 64 are operated (S20), setting the torque distribution ratio with respect to the first pump 52 and the second pump 54 (S40), detecting whether the operation amount of the first joystick 62 or the second joystick 64 is increased (S50), calculating the required torque of the first pump 52 and the required torque of the second pump 54 (S70), determining whether a sum of the required torque of the first pump 52 and the required torque of the second pump 54 is higher than the available torque (S80), analyzing an operation pattern of the first joystick 62 and the second joystick 64 and determining whether the operation pattern is an excavation operation (S90), and adjusting the torque distribution ratio so as to increase the distribution ratio with respect to the pump, between the first pump 52 and the second pump 54, which supplies the working fluid to the actuator controlled by the joystick of which the operation amount is increased (S100). In addition, the method of controlling the construction machine according to the exemplary embodiment of the present disclosure may further include, before the detecting of whether both of the first joystick 62 and the second joystick 64 are operated (S20), selecting an operation mode of the construction machine and setting the available torque in accordance with the operation mode (S10). In addition, the method of controlling the construction machine according to the exemplary embodiment of the present disclosure may further include, after the adjusting of the torque distribution ratio (S100), determining whether the available torque is lower than the maximum output of the engine 70 in the operation mode selected by the operation mode selecting unit 30 (S110), and increasing the available torque so that the available torque is equal to or lower than the maximum output of the engine 70 in the operation mode when the available torque is lower than the maximum output of the engine 70 in the operation mode selected by the operation mode selecting unit 30 (S120). Hereinafter, the respective steps will be described in detail.

In the selecting of the operation mode of the construction machine and the setting of the available torque in accordance with the operation mode (S10), the operation mode of the construction machine is selected first by the user. The user may select one of at least two operation modes provided in advance. When the operation mode is selected by the user, the available torque to be provided to the first and second pumps 52 and 54 may be set corresponding to the operation mode. However, this step is not an essential process in the present exemplary embodiment, and this process may be omitted in a construction machine which is not provided with the multiple operation modes, and this process may also be omitted in a construction machine which is provided with the multiple operation modes.

Next, in the detecting of whether both of the first joystick 62 and the second joystick 64 are operated (S20), the operation amounts of the first and second joysticks 62 and 64 is detected by the joystick operation amount acquiring unit 10. When the operation amounts of the first and second joysticks 62 and 64 is detected, the control unit 20 may determine whether both of the first and second joysticks 62 and 64 are operated. When it is determined that both of the first and second joysticks 62 and 64 are operated after the determining of whether both of the first and second joysticks 62 and 64 are operated (S30), the process goes to the next step, but when it is not determined that both of the first and second joysticks 62 and 64 are operated, the operation amounts of the first and second joysticks 62 and 64 is continuously detected until it is determined that both of the first and second joysticks 62 and 64 are operated.

The torque distribution ratio with respect to the first and second pumps 52 and 54 is set (S40) when both of the first and second joysticks 62 and 64 are operated. The torque distribution ratio may be set by the control unit 20. The method of setting the torque distribution ratio is as described above. When the torque distribution ratio is set, the available torque is distributed to the first and second pumps 52 and 54 in accordance with the corresponding ratio, such that the first and second pumps 52 and 54 may be operated.

Thereafter, whether the operation amount of the first joystick 62 or the second joystick 64 is increased is detected (S50) while the available torque is distributed in accordance with the torque distribution ratio and the first and second pumps 52 and 54 are operated, and when the operation amount of any one of the first joystick 62 and the second joystick 64 is increased (S60), the required torque of the first pump 52 and the required torque of the second pump 54 are calculated (S70). The required torque of the first and second pumps 52 and 54 may be represented by the product of required pressure and required flow rate (Required Torque=Required Pressure×Required Flow Rate). In this case, the required pressure may be obtained from the control signal outputted from the control unit 20, and the required flow rate may be obtained from the operation amounts of the first and second joysticks 62 and 64.

When the required torque of the first pump 52 and the required torque of the second pump 54 are calculated, whether a sum of the required torque of the first pump 52 and the required torque of the second pump 54 is higher than the available torque is determined (S80). If the sum of the required torque of the first pump 52 and the required torque of the second pump 54 is equal to or lower than the available torque, it is not necessary to adjust the torque distribution ratio because required torque may be provided to the first pump 52 and the second pump 54. In contrast, if the sum of the required torque of the first pump 52 and the required torque of the second pump 54 is higher than the available torque, it is necessary to distribute the available torque to the first pump 52 and the second pump 54 in accordance with an appropriate ratio because required torque cannot be provided to both of the first pump 52 and the second pump 54.

If the sum of the required torque of the first pump 52 and the required torque of the second pump 54 is higher than the available torque, whether the operation pattern is an excavation operation is determined (S90). If the operation pattern is an excavation operation, the torque distribution ratio may be adjusted in order to increase the distribution ratio with respect to the pump, between the first pump 52 and the second pump 54, which supplies the working fluid to the actuator controlled by the joystick of which the operation amount is increased (S100). The increase in operation amount of the joystick during the particular operation means that the user wants the operation, which is performed by the operation of the corresponding joystick, to be quickly performed to that extent, and as a result, the corresponding operation may be quickly performed by increasing a ratio of the available torque to be distributed to the pump for supplying the working fluid to the actuator controlled by the joystick of which the operation amount is increased. As illustrated in FIG. 5, when the torque distribution ratio is adjusted, the torque to be distributed to any one pump (second pump) is increased (from B1 to B2), and the torque to be distributed to the other pump (first pump) is decreased (from A1 to A2). When the control unit 20 outputs a pump control signal in accordance with the torque distribution ratio adjusted as described above, the discharge flow rate and the discharge pressure of the first and second pumps 52 and 54 may be controlled.

Meanwhile, after the torque distribution ratio is adjusted, it is possible to determine whether the available torque is lower than the maximum output of the engine 70 in the operation mode selected by the operation mode selecting unit 30 (S110). In this case, if the available torque is lower than the maximum output of the engine 70 in the operation mode selected by the operation mode selecting unit 30, the available torque may be changed to be equal to the maximum output of the engine 70 in the operation mode (S120).

Meanwhile, the adjustment of the torque distribution ratio as described in the present exemplary embodiment may be performed only when the excavation operation is performed, or may be always performed regardless of the type of operation. In the case in which the adjustment of the torque distribution ratio is performed only when the excavation operation is performed, the control unit 20 analyzes an operation pattern of the first joystick 62 and the second joystick 64 and determines whether the corresponding operation is the excavation operation (S90), and then the control unit 20 may adjust the torque distribution ratio with respect to the first pump 52 and the second pump 54 only when it is determined that the corresponding operation is the excavation operation.

The above description is simply given for illustratively describing the technical spirit of the present disclosure, and those skilled in the art to which the present disclosure pertains will appreciate that various modifications, changes and substitutions are possible without departing from the essential characteristic of the present disclosure. Therefore, the exemplary embodiments of the present disclosure are provided for illustrative purposes only but not intended to limit the technical concept of the present disclosure, and the scope of the technical spirit of the present disclosure is not limited thereto. The protective scope of the present disclosure should be construed based on the following claims, and all the technical spirit in the equivalent scope thereto should be construed as falling within the scope of the present disclosure.

INDUSTRIAL APPLICABILITY

The construction machine and the method of controlling a construction machine according to the present disclosure may be used to operate the construction machine in order to more appropriately meet the user's intention since a distribution ratio of the available torque with respect to the first and second pumps is primarily set in accordance with types of complex operations and then a torque distribution ratio is adjusted in accordance with a change in operation amount of the joystick.

The invention claimed is:

1. A construction machine comprising:

a first pump and a second pump;

an engine which provides an available torque to the first pump and the second pump;

a first joystick and a second joystick which control actuators operated by a working fluid discharged from the first pump and the second pump;

a joystick operation amount acquiring unit which acquires operation amounts of the first joystick and the second joystick; and a control unit, wherein when the operation amounts of the first joystick and the second joystick are increased while the construction machine performs a complex operation in which both of the first joystick and the second joystick are operated in a state in which a sum of required torque of the first pump and required torque of the second pump is higher than the available torque, the control unit adjusts a torque distribution ratio with respect to the first pump and the second pump in accordance with the operation amounts of the first joystick and the second joystick in order to increase a distribution ratio between the first pump and the second pump, and supply the working fluid to one of the actuators controlled by either the first joystick or the second joystick in which the operation amount is increased by a greater amount based on a comparison between the increased operation amount of the first joystick to the increased operation amount of the second joystick.

2. The construction machine of claim 1, wherein the actuators include a boom actuator, an arm actuator, a bucket actuator, and a turning actuator, the first joystick controls at least two actuators among the boom actuator, the arm actuator, the bucket actuator, and the turning actuator, and the second joystick controls the remaining actuators.

3. The construction machine of claim 2, wherein the control unit determines the torque distribution ratio in accordance with types of complex operations of the boom actuator, the arm actuator, the bucket actuator, and the turning actuator.

4. The construction machine of claim 1, wherein each of the first pump and the second pump is an electronic control pump, and the required torque is controlled by the control unit.

5. The construction machine of claim 4, further comprising:

an operation mode selecting unit which selects an operation mode of the construction machine, wherein when the sum of the required torque of the first pump and the required torque of the second pump is higher than the available torque and the available torque is lower than a maximum output of the engine in the operation mode selected by the operation mode selecting unit, the control unit increases the available torque so that the available torque is equal to or lower than the maximum output of the engine in the operation mode.

6. The construction machine of claim 5, further comprising:

a memory which stores the types of operation modes, and the available torque and the maximum output of the engine in accordance with the operation mode.

7. A construction machine comprising:

a first pump and a second pump;

an engine which provides an available torque to the first pump and the second pump;

a first joystick and a second joystick which control actuators operated by a working fluid discharged from the first pump and the second pump;

a joystick operation amount acquiring unit which acquires operation amounts of the first joystick and the second joystick;

an operation mode selecting unit which selects an operation mode of the construction machine; and a control unit, wherein when the operation amounts of the first joystick and the second joystick are increased while the construction machine performs a complex operation in which both of the first joystick and the second joystick are operated in a state in which a sum of required torque of the first pump and required torque of the second pump is higher than the available torque and the available torque is lower than a maximum output of the engine in the operation mode selected by the operation mode selecting unit, the control unit adjusts a torque distribution ratio in order to increase the available torque so that the available torque is equal to or lower than the maximum output of the engine in the operation mode and increase a distribution ratio, the distribution ratio being a ratio of the available torque outputted from the engine and distributed to the first pump and the second pump, and supply the working fluid to one of the actuators controlled by either the first joystick or the second joystick in which the operation amount is increased by a greater amount based on a comparison between the increased operation amount of the first joystick to the increased operation amount of the second joystick.

8. A method of controlling a construction machine which distributes an available torque, which is provided from an engine of the construction machine including a first pump and a second pump, to the first pump and the second pump, the method comprising:

detecting whether both a first joystick and a second joystick control actuators operated by a working fluid discharged from the first pump and the second pump;

setting a torque distribution ratio which is a ratio of the available torque outputted from the engine and distributed to the first pump and the second pump when both of the first joystick and the second joystick control the actuators;

detecting whether an operation amount of the first joystick and an operation amount of the second joystick are increased;

comparing the increased operation amounts of the first joystick to the second joystick;

determining whether a sum of required torque of the first pump and required torque of the second pump is higher than the available torque; and adjusting the torque distribution ratio with respect to the first pump and the second pump in accordance with the operation amounts of the first joystick and the second joystick when the sum of the required torque of the first pump and the required torque of the second pump is higher than the available torque, and supplying the working fluid to one of the actuators controlled by either the first joystick or the second joystick in which the operation amount is increased by a greater amount based on said comparing the increased operation amounts of the first joystick to the second joystick.

9. The method of claim 8, further comprising:

setting the available torque in accordance with an operation mode after the operation mode of the construction machine is selected.

10. The method of claim 8, further comprising:

analyzing an operation pattern of the first joystick and the second joystick, and determining whether the operation pattern is an excavation operation.

* * * * *